United States Patent [19]

Oka et al.

[11] Patent Number: 5,047,805

[45] Date of Patent: Sep. 10, 1991

[54] DEVELOPING DEVICE HAVING A SPACE FOR RECEIVING AND INCREASING PRESSURE OF TONER RECEIVED THEREIN

[75] Inventors: Tateki Oka; Naoki Toyoshi, both of Toyohashi; Hiroshi Goto, Toyokawa; Hirofumi Hasegawa, Hatano; Kenji Miyashita, Aichi, all of Japan

[73] Assignee: Minolta Camera Kabushiki Kaisha, Osaka, Japan

[21] Appl. No.: 552,536

[22] Filed: Jul. 16, 1990

[30] Foreign Application Priority Data

Jul. 17, 1989 [JP] Japan ..... 1-185267

[51] Int. Cl.[5] ..... G03G 15/09

[52] U.S. Cl. ..... 355/253; 118/653; 355/259

[58] Field of Search ..... 355/245, 253, 259, 251; 118/651, 653, 661, 656–658

[56] References Cited

U.S. PATENT DOCUMENTS

| | | | |
|---|---|---|---|
| 4,760,422 | 7/1988 | Seimiya et al. | 118/656 X |
| 4,786,936 | 11/1988 | Ikegawa et al. | 118/651 X |
| 4,791,882 | 12/1988 | Enoguchi et al. | 118/653 |
| 4,809,034 | 2/1989 | Murasaki et al. | 355/253 |
| 4,827,869 | 5/1989 | Takagi | 118/651 X |
| 4,851,872 | 7/1989 | Murasaki et al. | 355/253 |
| 4,912,513 | 3/1990 | Oka et al. | 355/253 |
| 4,947,212 | 8/1990 | Ikegawa et al. | 355/253 X |

FOREIGN PATENT DOCUMENTS

| | | | |
|---|---|---|---|
| 63-48576 | 3/1988 | Japan . | |
| 0311367 | 12/1988 | Japan | 355/245 |

*Primary Examiner*—A. T. Grimley
*Assistant Examiner*—William J. Royer
*Attorney, Agent, or Firm*—Burns, Doane, Swecker & Mathis

[57] ABSTRACT

A developing device having a toner carrying member for transporting toner to a photosensitive member, a toner supplying member facing to the toner carrying member with an opening therebetween for supplying toner to the toner carrying member and a seal member for substantially closing a toner path. In the developing device a scraping member is further provided in contact with the toner supplying member to scrape the toner therefrom and an accommodating space is formed by the toner carrying member, toner supplying member, seal member and scraping member. Thus the toner transported by the toner supplying member is accommodated in the accommodating space and then supplied to the toner holding member under pressure accompanied by the increase of the toner accommodated therein, whereby an adequate quantity of toner is supplied for development.

16 Claims, 3 Drawing Sheets

DEVELOPING DEVICE HAVING A SPACE FOR RECEIVING AND INCREASING PRESSURE OF TONER RECEIVED THEREIN

BACKGROUND OF THE INVENTION

1 Field of the Invention

The present invention relates to a developing device for copying machines, printers and the like.

2. Description of the Related Art

Conventional developing devices provide a toner carrying member, a regulating member that makes pressure contact with said toner carrying member, and a toner supplying roller that makes contact with said toner carrying member. In the aforesaid developing device, toner is supplied to the surface of the toner carrying member by the toner supplying roller so as to form a toner layer thereon, such that said toner is supplied to the surface of a photoconductive member by means of the rotation of the aforesaid toner carrying member, thereby performing the developing process.

Because the aforesaid developing device is constructed in such a way that the toner supplying roller and the toner carrying member make contact, and after developing, the residual toner layer remaining on the surface of the toner carrying member is disturbed, and the toner layer on the toner carrying member becomes nonuniform due to the transporting of toner to the aforesaid disturbed toner layer. Further, the toner receives an unnecessary electrical charge through the static electricity generated by the aforesaid contact, resulting in the disadvantage of producing fogging and variable density irregularities in the developed image.

A developing device having a toner supplying roller confronting a toner carrying member so as to maintain a space therebetween to eliminate the aforesaid disadvantages has been proposed in Japanese Laid-Open Patent Application No. 63-48576. In the aforesaid developing device, there is no touching contact between the toner supplying roller and the toner carrying member because the toner supplying roller and toner carrying member are maintained with a space therebetween, such that the residual toner layer formed on the surface of the toner carrying member is not disturbed. In addition, there is no unnecessary electrical charging of the toner, and post-development image characteristics can be stabilized.

On the other hand, an adequate quantity of toner is not maintained on the surface of the toner carrying member because a means for positively thrusting toner onto the toner carrying member is not provided in the previously described developing device. Accordingly, the quantity of toner supplied for developing is not enough, and the image density is reduced for images having a large surface area, thereby producing the disadvantages of missing dots (white spots), variable density irregularities, and reduced image quality.

SUMMARY OF THE INVENTION

A main object of the present invention is to provide a developing device capable of producing high quality images having uniform densities.

A further object of the present invention is to provide a developing device having a means for supplying an adequate quantity of toner to the surface of a toner carrying member.

These and other objects of the present invention are accomplished by providing a developing device having a rotatably driven toner carrying member, a toner supplying roller disposed opposite the aforesaid toner carrying member so as to maintain a specified spacing therebetween, a seal member arranged so as to be touching the aforesaid toner carrying member and disposed on downstream of the developing portion and upstream of the opposite portion where the toner carrying member opposes to the toner supplying roller, a scraping member disposed so as to be touching the exterior surface of the toner supplying roller to scrape the toner maintained on said exterior surface of the toner supplying roller, and a sealed accommodating space for holding the toner scraped by the aforesaid scraping member in the portion constituted by the aforesaid seal member, toner carrying member, toner supplying roller and scraping member, said sealed accommodating space having an opening at said opposite portion.

According to the previously described construction, the toner scraped from the toner supplying roller by the scraping member is stored in the collecting space. The toner pressure is elevated as the quantity of toner accommodated in the accommodating space increases, and a suitable quantity of toner is supplied to the surface of the toner supplying roller by means of the aforesaid toner pressure elevation.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
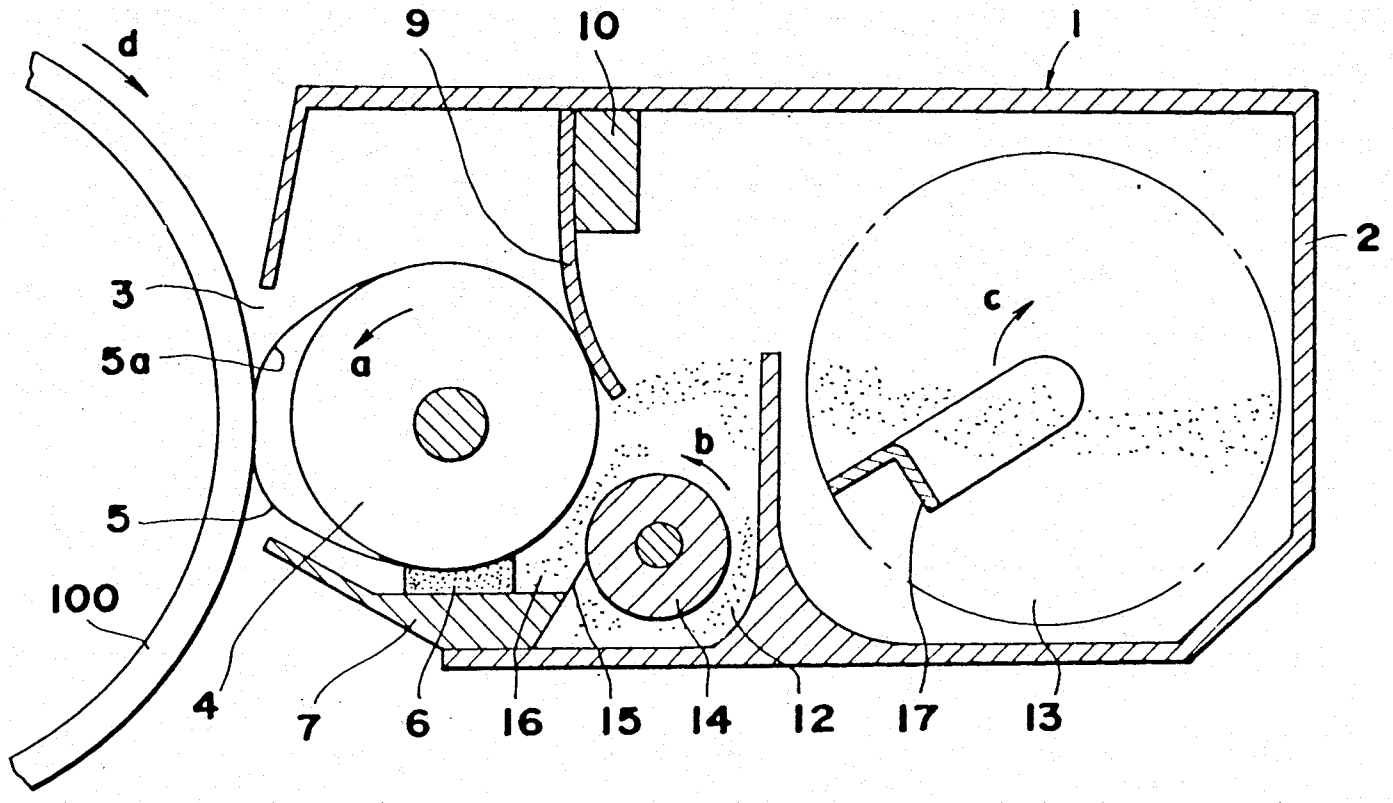
FIG. 1 is a section view of the developing device of the present invention.

In FIG. 1, developing tank 2 in developing device 1 is provided an opening 3 disposed opposite photoconductive member 100. Rotating member 4 is arranged inside the aforesaid opening 3, and is rotatingly driven in the direction indicated by arrow [a]. Belt sleeve 5 is a thin-layer cylindrical member with fine concavo-convexities provided on the exterior surface thereof, with a circumference somewhat longer than the circumference of the aforesaid rotating member 4 around which said belt sleeve 5 is mounted. Belt sleeve 5 adheres to the exterior surface of rotating member 4 at the side opposite to that of photoconductive member 100 by means of pressure members not shown in the drawings which are disposed at both ends thereof, such that a bulge 5*a* formed opposite said photoconductive member 100 makes touching contact with the exterior surface of said photoconductive member 100. Seal member 6 is attached to support member 7 mounted on the bottom plate of developing tank 2, and makes touching contact with the bottom exterior surface of belt sleeve 5. Said seal member is arranged to slightly pressing contact with the toner carrying member or to face the toner carrying member with a minute gap therebetween so that residual toner remaining on belt sleeve 5 after development passes through said seal member. Blade 9 is attached to support member 10 mounted on the lid roof portion of developing tank 2, and the surface of one side of said blade 9 covers the exterior surface of rotating member 4 through belt sleeve 5. At the inner side of photoconductive member 100 as viewed from the opening of the developing tank are disposed a buffer space 12 and a supply chamber 13 which are divided by upward extended bottom plate of developing tank 2. Toner supplying roller 14 is accommodated in buffer space 12, and is rotatably driven in the direction of arrow [b]. Further, the leading edge of a scraper 15 attached to support member 7 makes pressure contact with the exterior surface of toner supplying roller 4. An accommodating space 16 is formed by scraper 15, seal member 6, support member 7, supplying roller 14 and belt sleeve 5 and has an opening at opposite portion 18 disposed between belt sleeve 5 and supplying roller 14.

Supply blade 17 is accommodated within a supply chamber 13 so as to be rotatably driven in the arrow [c] direction.

In the aforesaid construction, the toner accommodated within supply chamber 13 is supplied to the buffer space 12 by means of the rotation of supply blade 17.

Figure 2:
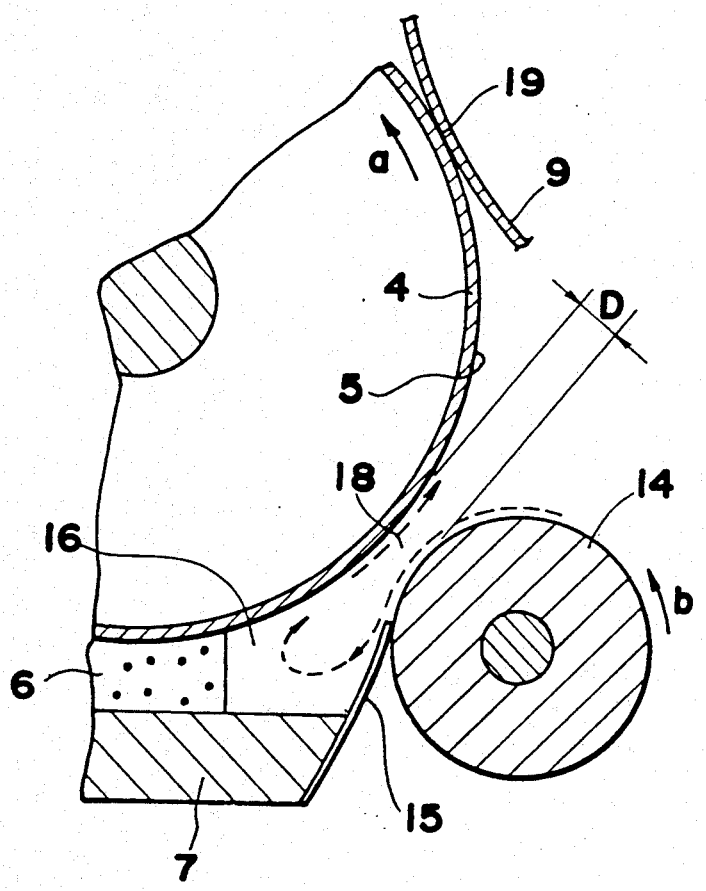
FIGS. 2 and 3 are partial enlargements of the developing device shown in FIG. 1.

In buffer space 12, the toner on the exterior surface of toner supplying roller 14 is electrically charged through contact with the rotating roller 14, and the charged toner is electrostatically maintained on said exterior surface of toner supplying roller 14. The toner maintained on the surface of supplying roller 14 is transported in the arrow [b] direction along with the rotation of supplying roller 14, as shown in FIG. 2, passes through the opposite portion 18 facing belt sleeve 5, and reaches accommodating space 16 where said toner is scraped from the surface of roller 14 by the leading edge of scraper 15, thence travels along the path within accommodating space 16 which is indicated by the dashed line, and is then supported on the exterior surface of belt sleeve 5 to be transported in the arrow [a] direction.

When a suitable quantity of toner is deposited in accommodating space 16, the toner pressure and toner density increase. The elevated pressure acts as a pressing force to thrust the toner against belt sleeve 5, thereby increasing the quantity of toner maintained and the quantity of toner transported on said belt sleeve 5. Further, the toner pressure in accommodating space 16 stabilizes in a state wherein the toner quantity input by supplying roller 14 and the toner quantity output by belt sleeve 5 are balanced, and in said state the quantity of toner transported by said belt sleeve 5 is constant.

The toner maintained and transported on belt sleeve 5 passes portion 18 opposite supplying roller 14 and is formed into a uniformly thin layer by contact portion 19 of blade 9. When the toner passes contact portion 19, said toner comes into contact with blade 9 and is thereby electrically charged.

Toner that has passed the contact portion 19 travels in the arrow [a] direction in conjunction with belt sleeve 5, and makes contact with the exterior surface of photoconductive member 100 travelling in the arrow [d] direction at the contact region (developing region) of photoconductive member 100 and belt sleeve 5, and if an electrostatic latent image is formed on the surface of said photoconductive member 100 the aforesaid charged toner adheres thereto, thereby developing the aforesaid electrostatic latent image.

Toner that has passed the developing region travels past the portion where seal member 6 faces belt sleeve 5, and when said toner passes accommodating space 16 the toner is replenished in an amount commensurate with the quantity used in the developing region.

Accordingly, when the toner in buffer space 12 is consumed, the toner within the supply chamber 13 is supplied to buffer space 12 based on the rotation of supply blade 17.

EXAMPLE 1

The number of rotations (peripheral speed) of supplying roller 14 was changed and the image density of solid images were measured. The measurement results are shown in Table 1.

The toner used was a nonmagnetic material 50% ($D_{50}$) of which had a mean particle diameter of 10.5 μm. Supply roller 14 was an aluminum roller having fine concavo-convexities with a mean depth of 2 μm or less formed on the surface thereof; rotating roller 4 was a rubber roller. Belt sleeve 5 was a nickel electroformed belt having a thickness of 40 μm and fine concavities with a depth of 2–3 μm formed on the surface thereof. Scraper 15 was a polyester film sheet having a thickness of 0.1 mm. The aforesaid conditions were identical in all tests described hereinafter.

TABLE 1

| RPM | Circumferential speed (mm/sec) | Evaluation |
|---|---|---|
| 127 | 80 | Image density not reduced |
| 112 | 70 | Image density not reduced |
| 96 | 60 | Image density not reduced |
| 80 | 50 | Image density not reduced |
| 64 | 40 | Image density not reduced |
| 48 | 30 | Image density reduced |

*Circumferential speed of photoconductive member 100:35 mm/s

Then, the same tests were repeated with variations of the circumferential speed of photoconductive member 100. The results of the tests are shown in Table 2.

TABLE 2

| RPM | Circumferential speed (mm/sec) | Evaluation |
|---|---|---|
| 127 | 80 | Image density reduced |
| 112 | 70 | Image density reduced |
| 96 | 60 | Image density not reduced |
| 80 | 50 | Image density not reduced |
| 64 | 40 | Image density not reduced |
| 48 | 30 | Image density not reduced |

Circumferential speed of supply roller 14:65 mm/s

According to the previously described experiments, image density is not reduced and a constant uniform image density can be reproduced even in developing solid images when the circumferential speed of supply roller 14 exceeds the circumferential speed of photoconductive member 100.

The above results are thought to be due to the reasons described hereinafter. That is, transportation of the toner on the supply roller 14 is dependent on the electrostatic force which adheres the toner to the surface of the roller, and the amount of toner transported is limited by the toner quantity of a layer. The toner adhesion quantity is approximately 1 mg/cm$^2$, which is equivalent to the toner adhesion quantity of a solid image. Therefore, toner necessary for developing is supplied when the circumferential speed of supply roller 14 exceeds the circumferential speed of photoconductive member 100.

In developing device 1, the quantity of toner consumed at least by a solid image forming process must be supplied to accommodating space 16, and that is the extent of the toner transportability required of supply roller 14. That is, the circumferential speed of supply roller 14 must exceed the circumferential speed of photoconductive member 100.

EXAMPLE 2

The amount of gap [D] between belt sleeve 5 and supply roller 14, and the diameter of supply roller 14 were changed and solid images developed. The quality of the obtained images was evaluated, the results of which are shown in Table 3.

TABLE 3

| Roller dia (mm) | D (mm) | Evaluation |
|---|---|---|
| 12.0 | 1.2 | Good image quality |
| 12.4 | 1.0 | Good image quality |
| 12.8 | 0.8 | Nonuniform density |
| 13.2 | 0.6 | Nonuniform density + increased torque |
| 11.0 | 1.7 | Good image quality |
| 10.0 | 2.3 | Good image quality |

As shown in Table 3, nonuniform density was manifest when gap [D] was narrower than 1.0 mm, and the supply roller 14 torque increased when gap [D] was 0.6 mm.

The above results are thought to be due to the reasons described hereinafter. That is, when gap [D] between belt sleeve 5 and supply roller 14 became narrower, the action of the toner on both sides intruded into the opposite portion 18, and the toner action was disturbed along the rotation of belt sleeve 5. The aforesaid disturbance resulted in the toner pressure (density) in accommodating space 16 becoming greater than necessary which impaired toner flow characteristics and caused the toner to clump and uniform toner supply to belt sleeve 5 became impossible producing nonuniform density in solid images and may have been due to the increased torque.

Accordingly, the spacing between belt sleeve 5 and supply roller 14 must be maintained at not less than 1 mm. Further, it is desirable that the upper limit be about 3 mm because the toner pressure (density) within accommodating space 16 gradually decreases as the spacing widens.

EXAMPLE 3

The material used for scraper 15 was changed and solid images were developed, then image quality was evaluated. The results of the evaluations are shown in Table 4.

TABLE 4

| Material | Thickness (mm) | Evaluation |
|---|---|---|
| Polyester | 0.10 | Good quality image |
| Phosphor bronze | 0.05 | Nonuniform density |
| Stainless steel | 0.05 | Nonuniform density |
| *Phosphor bronze | 0.05 | Good image quality |

*Phosphor bronze core with surface coated with teflon tape (thickness: 50 μm)

According to Table 4, nonuniform image density was produced by the device using a scraper having a conductive material on the surface confronting the accommodating space 16, while no problems with the images were found when using a scraper having an insulative material (teflon tape) attached to its surface.

Figure 3:
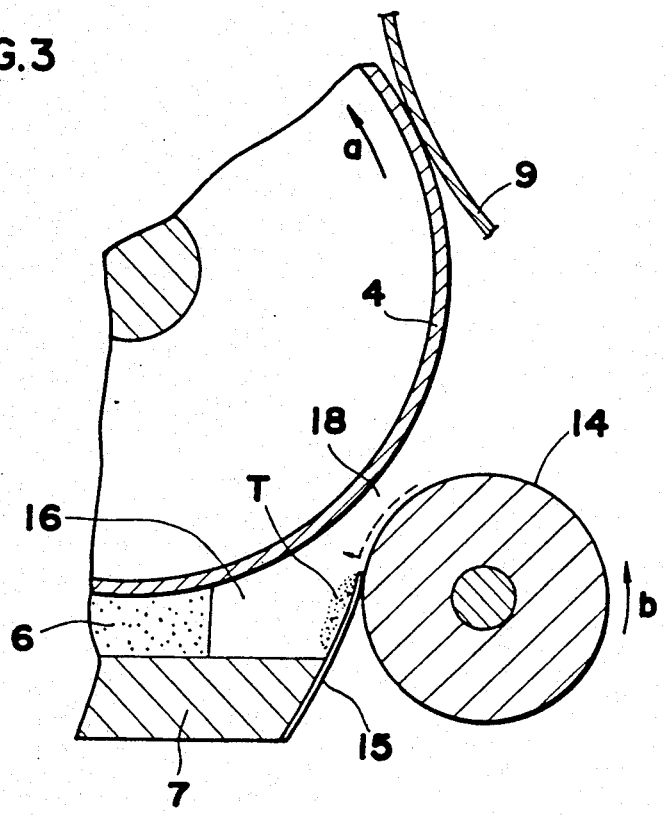

When the interior of developing tank 2 was examined after developing, it was found that devices using scrapers made of conductive material shad toner [T] adhering to the surface of scraper 15 bordering the accommodaing space 16, as shown in FIG. 3.

Based on the aforesaid findings, it is thought that when scraper 15 is made of a conductive material, the toner required for belt sleeve 5 cannot be supplied because the toner does not circulate in accommodating space 16 due to the strong adhesion of said toner to the surface of scraper 15 induced by the electrostatic force influencing said toner which is charged by the scraping action of scraper 15.

Accordingly, in the developing device of the present invention, the toner must travel smoothly along scraper 15, and to that end at least the surface of said scraper 15 must be constructed of an insulative material.

Figure 4:
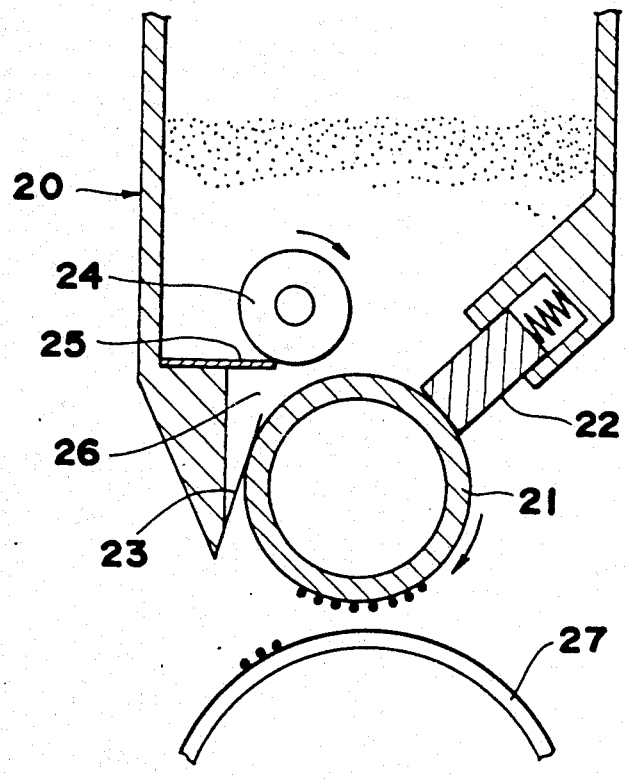
FIG. 4 is a section view of another embodiment of the developing device of the present invention.

Although the present invention has been described in the preceding description as applicable for a developing device wherein a thin layer of charged toner is formed on the exterior surface of belt sleeve 5 which loops around rotating member 4, and developing is accomplished by having said belt sleeve 5 make direct contact with photoconductive member 100, said invention may also be adapted to developing device 20 shown in FIG. 4.

In developing device 20, a regulating member 22 and seal member 23 make contact with a roller 21 which confronts a rotating member 27 with a specified spacing maintained therebetween, and the leading edge of scraper 25 presses against supply roller 24 which is disposed opposite the aforesaid roller 21, such that the toner transported by supply roller 24 is scraped therefrom by scraper 25 and falls into accommodating portion 26 and adheres to the exterior surface of the aforesaid roller 21.

Accordingly, the toner maintained on the exterior surface of roller 21 is electrically charged by the contact portion of regulating member 22, and is transported to the portion opposite rotating member 27.

When the aforesaid rotating member 27 is a photoconductive member, the aforesaid charged toner is supplied to the electrostatic latent image formed on the surface of said photoconductive member.

Further, if rotating member 27 is a developing roller maintaining a carrier on the exterior surface thereof and is disposed opposite a photoconductive member (not shown in the drawing), the aforesaid charged toner is scraped by the carrier and supplied to the developing roller, whereupon said toner is mixed with the carrier to adjust a two-component developing material, and the electrostatic latent image formed on the photoconductive member can be developed using the aforesaid adjusted two-component developing material.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device comprising:

a rotatable toner carrying member for transporting toner to a rotatable member;

a rotatable toner supplying member facing to said toner carrying member with a predetermined distance therebetween for supplying toner to the surface of said toner carrying member;

a scrape member contacting with said toner supplying member for scraping the toner from the surface of said toner supplying member; and a seal member facing said toner carrying member wherein said toner carrying member, toner supplying member, seal member and scrape member constitute a space for storing the toner therein so that the toner is supplied therefrom onto said toner carrying member due to increased pressure from the toner stored in said space.

2. A developing device comprising:

toner carrying means rotatable to develop an electrostatic latent image at a developing region;

toner supplying means for supplying toner by rotation thereof, said toner supplying means so provided to face with said toner carrying means with an opening therebetween at a downstream side of the developing region relative to rotary direction of the toner carrying member;

scraping means in contact with said toner supplying means to scrape off toner therefrom;

seal means provided at an upstream side of said opening relative to rotary direction of the toner carrying means and so disposed to face with said toner carrying means, said seal means substantially closing a path through which toner moves; and a toner accommodating space constituted at least by said toner carrying means, scraping means and seal means for accommodating toner therein so as to transport the toner from said toner supplying means to said toner carrying means therethrough due to increased pressure from the toner stored in said space.

3. The developing device as claimed in claim 2, wherein said opening between said tone carrying means and toner supplying means is more than 1 mm so as to supply uniform amount of toner to said toner carrying means.

4. The developing device as claimed in claim 2 wherein said toner carrying means faces at said developing region a rotatable photoconductive member which is supplied with toner thereto from said toner supplying means through said toner carrying means, and the circumferential speed of said toner supplying roller is faster than that of said photoconductive member to supply enough amount of toner thereto.

5. The developing device as claimed in claim 2, wherein the surface of said scrape means is made of insulating member to prevent the scraped toner from adhering said scraping means.

6. The developing device as claimed in claim 2, wherein the seal means is an elastic member.

7. The developing device as claimed in claim 2, wherein said scrape means contacts said toner supplying means at a downstream side of said opening relative to the rotational direction of said toner supplying means.

8. The developing device as claimed in claim 2, wherein said toner supplying means is rotatable counterclockwise and said scrape means is in pressing contact with said toner supplying means against the rotational direction of said toner supplying means.

9. The developing device as claimed in claim 8, wherein the leading edge of said scrape means is in pressing contact with said toner supplying means.

10. A developing device comprising:

a rotatable toner carrying member for transporting toner to a photosensitive member;

a toner supplying member rotatable in the same direction as said toner carrying member and facing said toner carrying member with a predetermined distance therebetween for supplying toner to said toner carrying member;

a scraping member in contact with said toner supplying member at the downstream side of where said toner supplying member faces said toner carrying member relative to the rotating direction of the toner supplying member for scraping the toner from said toner supplying member;

a seal member facing said toner carrying member and provided at a position upstream of where said toner supplying member faces said toner carrying member relative to the rotating direction of the toner carrying member; and a toner accommodation space including an opening at the portion where the toner carrying member faces the toner supplying member, said toner accommodation space being enclosed with at least said toner carrying member, seal member and scraping member for accommodating the toner scraped by said scrape member therein and transporting the toner to said toner carrying member under pressure accompanied by the increase of the toner accommodated therein.

11. The developing device as claimed in claim 10, wherein the said predetermined distance between said toner carrying member and said toner supplying member is more than about 1 mm to prevent the collision of the toner movement at the portion where said toner carrying member faces said toner supplying member.

12. The developing device as claimed in claim 10, wherein the rotary velocity of said toner supplying member is faster than that of the photoconductive member to supply enough amount of toner thereto.

13. The developing device as claimed in claim 10, wherein at least the surface of said scraping member is made of insulating member to prevent the scraped toner from adhering to said scraping member.

14. The developing device as claimed in claim 10, wherein the seal member is an elastic member.

15. The developing device as claimed in claim 10, wherein said toner supplying member is rotatable counterclockwise and said scraping member is in pressing contact with said toner supplying means against the rotational direction of said toner supplying means.

16. The developing device as claimed in claim 15, wherein the leading edge of said scraping member is in pressing contact with said toner supplying means.

* * * * *